US012359143B2

(12) United States Patent
Barton et al.

(10) Patent No.: US 12,359,143 B2
(45) **Date of Patent: *Jul. 15, 2025**

(54) COMPOSITION AND METHOD FOR LUBRICATING AUTOMOTIVE GEARS, AXLES AND BEARINGS

(71) Applicant: The Lubrizol Corporation, Wickliffe, OH (US)

(72) Inventors: William R. S. Barton, Belper (GB); Brian B. Filippini, University Heights, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/211,869

(22) Filed: Jun. 20, 2023

(65) Prior Publication Data

US 2023/0416632 A1 Dec. 28, 2023

Related U.S. Application Data

(63) Continuation of application No. 17/265,242, filed as application No. PCT/US2019/044660 on Aug. 1, 2019, now Pat. No. 11,732,208.

(60) Provisional application No. 62/715,041, filed on Aug. 6, 2018.

(51) Int. Cl.

| | |
|---|---|
| ***C10M 137/10*** | (2006.01) |
| ***C10M 135/36*** | (2006.01) |
| ***C10M 137/08*** | (2006.01) |
| ***C10M 169/04*** | (2006.01) |
| ***C10N 10/14*** | (2006.01) |
| ***C10N 20/02*** | (2006.01) |
| ***C10N 30/00*** | (2006.01) |
| ***C10N 30/04*** | (2006.01) |
| ***C10N 30/06*** | (2006.01) |
| ***C10N 40/02*** | (2006.01) |
| ***C10N 40/04*** | (2006.01) |

(52) U.S. Cl.

CPC ..... *C10M 137/10* (2013.01); *C10M 135/36* (2013.01); *C10M 137/08* (2013.01); *C10M 169/04* (2013.01); *C10M 2219/106* (2013.01); *C10M 2223/043* (2013.01); *C10M 2223/045* (2013.01); *C10N 2010/14* (2013.01); *C10N 2020/02* (2013.01); *C10N 2030/04* (2013.01); *C10N 2030/06* (2013.01); *C10N 2030/43* (2020.05); *C10N 2040/02* (2013.01); *C10N 2040/04* (2013.01)

(58) Field of Classification Search

CPC ..... C10M 135/36; C10M 137/00; C10M 137/08; C10M 137/10; C10M 141/10; C10M 169/04; C10M 2209/084; C10M 2219/022; C10M 2219/106; C10M 2223/04; C10M 2223/043; C10M 2223/045; C10N 2010/14; C10N 2020/02; C10N 2030/04; C10N 2030/06; C10N 2030/43; C10N 2040/02; C10N 2040/04; C10N 2040/044

See application file for complete search history.

(56) References Cited

U.S. PATENT DOCUMENTS

| | | | | |
|---|---|---|---|---|
| 8,153,565 | B2 * | 4/2012 | Tipton | C10M 141/10 508/192 |
| 11,732,208 | B2 * | 8/2023 | Barton | C10M 141/10 508/371 |
| 2006/0063685 | A1 * | 3/2006 | Purmer | C10M 141/10 508/273 |
| 2013/0225461 | A1 * | 8/2013 | Barton | C10M 137/08 508/428 |

* cited by examiner

*Primary Examiner* — James C Goloboy
(74) *Attorney, Agent, or Firm* — Christopher P. Demas; Michael A. Miller

(57) ABSTRACT

The disclosed technology relates to a lubricant composition for automotive gears, axles and bearings, the lubricant composition containing an oil of lubricating viscosity and a metal thiophosphate compound, such as zinc dialkyldithiophosphate, as well as a method of obtaining extreme pressure performance in automotive gears, axles and bearings at lower sulfur content than is typical, by lubricating such automotive gears, axles and bearings with a lubricant composition containing a metal thiophosphate compound, such as zinc dialkyldithiophosphate.

14 Claims, No Drawings

COMPOSITION AND METHOD FOR LUBRICATING AUTOMOTIVE GEARS, AXLES AND BEARINGS

CROSS REFERENCE TO RELATED APPLICATION

This application claims priority from U.S. Ser. No. 17/265,242 filed on 2 Feb. 2021, which claims the benefit of PCT Application Serial No. 2019/044660 filed on 1 Aug. 2019, which claims the benefit of U.S. Provisional Application No. 62/715,041 filed on 6 Aug. 2018, the entirety of which is hereby incorporated by reference.

BACKGROUND

The disclosed technology relates to a lubricant composition for automotive gears, axles, and bearings, the lubricant composition containing an oil of lubricating viscosity and a metal thiophosphate compound, such as zinc dialkyldithiophosphate, as well as a method of obtaining extreme pressure performance in automotive gears, axles, and bearings at lower sulfur content than is typical, by lubricating such automotive gears, axles, and bearings with a lubricant composition containing a metal thiophosphate compound, such as zinc dialkyldithiophosphate.

Driveline power transmitting devices (such as gears or transmissions) present highly challenging technological problems and solutions for satisfying the multiple and often conflicting lubricating requirements, while providing durability and cleanliness. Fluids for lubricating automotive gears in particular can be defined by adherence to the American Petroleum Institute ("API") category GL-5 ratings, which denotes lubricants intended for gears, particularly hypoid gears, in axles operating under various combinations of high-speed/shock load and low-speed/high-torque conditions, and specifically tests such as ASTM D7452 (former L-42). Manual transmission fluids can be evaluated for hardware protection by FZG gear scuffing, pitting and wear procedures such as FZG A10/16.6R/90, FZG A10/16.6R/120, further defined by the Coordinating European Council ("CEC") standards, such as the CEC L-84-02 FZG gear scuffing load carrying test. While these tests will determine if a suitable level of gear durability has been met, in neither case do these tests alone determine it to be suitable for use as considerations of friction, cleanliness, bearing life, seals and other performance parameters need to be considered.

For decades sulfurized olefins have been the main extreme pressure additive to actively control gear break in and shock loading, particularly for hypoid gear break in and shock loading to prevent adhesive wear under high contact pressures and temperatures. Sulfurized olefins can react in asperity contact to minimize adhesion through forming iron sulfides that have a lower shear stress than the parent steel that wear preferentially. However, high levels of active sulfur in sulfurized olefin can lead to corrosion of yellow metals that may be present in a driveline device, as well as to reduced thermal/oxidative stability of the gear lubricant composition, and contribute to the formation of thiol byproducts, which raise odor issues.

It would be beneficial to provide a combination of lower treat and lower sulfur in lubricant compositions for automotive gears, axles, and bearings, particularly for yellow metal (e.g., copper, sintered bronze) applications, as well as for improved oxidative stability, lower odor and improved gear break-in.

SUMMARY

It has been found that the use of metal thiophosphates can act in concert with, or even replace, typical sulfur containing materials in lubricant compositions for automotive gears, axles, and bearings, while still providing at least equivalent, if not improved, API GL-5 or FZG gear performance (including those defined by CEC procedures, such as CEC L-84-02) as the case may be, including scuffing, scoring, and extreme pressure performance, despite lower sulfur content in the lubricant compositions. This finding was surprising, as the majority of conventional literature is dominated by the use of metal thiophosphates, particularly zinc dialkyl dithiophosphates, to deliver a phosphate tribofilm for antiwear performance rather than for extreme pressure performance.

Thus, one aspect of the disclosed technology is related to a lubricant composition for automotive gears, axles, and bearings containing an oil of lubricating viscosity and a metal thiophosphate compound.

The metal thiophosphate compound can be a zinc dialkyldithiophosphate. In an embodiment, metal thiophosphate may be a primary or secondary zinc dialkyldithiophosphate, or a mixture thereof. In one embodiment, the metal thiophosphate can be a primary zinc dialkyldithiophosphate. In one embodiment, the metal thiophosphate can be a secondary zinc dialkyldithiophosphate.

The metal thiophosphate can be present in an amount to deliver about 100 ppm or greater metal to the lubricant composition. Such levels may be associated with a metal thiophosphate concentration of from about 100 ppm to about 5000 ppm.

The lubricant composition can have a total sulfur level of about 0.5 wt % or greater, such as, from 0.5 wt % to about 3 wt %, or from 0.5 wt % to 2 wt %.

The lubricant composition can also have a total phosphorous level of about 300 ppm or greater.

Other sources of phosphorus and sulfur may be present in the lubricant compositions, such as polysulfides, thiadiazoles, and non-metal thiophosphates.

Another aspect of the disclosed technology relates to a method of obtaining extreme pressure performance in automotive gears, axles, and bearings at lower sulfur content than is typical, by lubricating such automotive gears, axles, and bearings with a lubricant composition containing a metal thiophosphate compound, such as zinc dialkyldithiophosphate. The method can include supplying the mentioned lubricant composition to the automotive gears, axles, and bearings, and operating the automotive gears, axles, and bearings.

DETAILED DESCRIPTION

Various preferred features and embodiments will be described below by way of non-limiting illustration. One aspect of the invention is a lubricant composition for automotive gears, axles, and bearings containing (a) an oil of lubricating viscosity, (b) a metal thiophosphate, (c) a non-metal phosphorous containing compound.

Oil of Lubricating Viscosity

One component of the disclosed technology is an oil of lubricating viscosity, also referred to as a base oil. The base oil may be selected from any of the base oils in Groups I-V of the American Petroleum Institute (API) Base Oil Interchangeability Guide-lines (2011), namely

| Viscosity Index | | | | |
|---|---|---|---|---|
| Base Oil Category | Sulfur (%) | | Saturates (%) | Viscosity Index |
| Group I | >0.03 | and/or | <90 | 80 to less than 120 |
| Group II | ≤0.03 | and | ≥90 | 80 to less than 120 |
| Group III | ≤0.03 | and | ≥90 | ≥120 |
| Group IV | All polyalphaolefins (PAOs) | | | |
| Group V | All others not included in Groups I, II, III or IV | | | |

Groups I, II and III are mineral oil base stocks. Other generally recognized categories of base oils may be used, even if not officially identified by the API: Group II+, referring to materials of Group II having a viscosity index of 110-119 and lower volatility than other Group II oils; and Group III+, referring to materials of Group III having a viscosity index greater than or equal to 130. The oil of lubricating viscosity can include natural or synthetic oils and mixtures thereof. Mixture of mineral oil and synthetic oils, e.g., polyalphaolefin oils and/or polyester oils, may be used.

In one embodiment the oil of lubricating viscosity has a kinematic viscosity at 100° C. by ASTM D445 of 1.5 to 7.5, or 2 to 7, or 2.5 to 6.5, or 3 to 6 $mm^2/s$. In one embodiment the oil of lubricating viscosity comprises a poly alpha olefin having a kinematic viscosity at 100° C. by ASTM D445 of 1.5 to 7.5 or any of the other aforementioned ranges.

The Metal Thiophosphate Compound

The lubricant composition will further include a metal thiophosphate compound. Examples of metal thiophosphates include zinc isopropyl methylamyl dithiophosphate, zinc isopropyl isooctyl dithiophosphate, zinc di(cyclohexyl) dithiophosphate, zinc isobutyl 2-ethylhexyl dithiophosphate, zinc isopropyl 2-ethylhexyl dithiophosphate, zinc isobutyl isoamyl dithiophosphate, zinc isopropyl n-butyl dithiophosphate, calcium di(hexyl)dithiophosphate, and barium di(nonyl)dithiophosphate.

The metal thiophosphate may be a zinc dialkyldithiophosphate. Zinc dialkyldithiophosphates may be described as primary zinc dialkyldithiophosphates or as secondary zinc dialkyldithiophosphates, depending on the structure of the alcohol used in its preparation. In some embodiments the lubricant composition can include a primary zinc dialkyldithiophosphate. In some embodiments the lubricant composition can include a secondary zinc dialkyldithiophosphate. In some embodiments the lubricant composition can include a mixture of primary and secondary zinc dialkyldithiophosphates.

Metal from the metal thiophosphate, such as zinc, may be supplied to the lubricant in an amount of 100 ppm or greater of the lubricant composition, or from 100 ppm to 5000 ppm, such as 150 ppm to 4000 ppm, or 200 ppm to 3000 ppm of the lubricant composition.

Non-Metal Phosphorous Containing Compound

Lubricant compositions for automotive gears, axles, and bearings can be distinguished from other lubricant compositions, such as those for engine oils, by the presence of non-metal phosphorous containing compounds. The lubricant composition described herein will contain just such a non-metal phosphorous containing compound. Such compounds can include, for example, phosphorous amine salts, sulfur containing phosphorous amine salts, phosphites, phosphonates, sulfur containing phosphites, sulfur containing phosphonates, and non-metal dithiophosphates.

The phosphorous amine salt can be an amine salt of one or more of the following: phosphorus acid esters, dialkyldithiophosphoric acid esters, phosphites, phosphonates, and mixtures thereof. The amine salt of the phosphorus acid ester may comprise any of a variety of chemical structures. In particular, a variety of structures are possible when the phosphorus acid ester compound contains one or more sulfur atoms, that is, when the phosphorus-containing acid is a thiophosphorus acid ester, including mono- or dithiophosphorus acid esters. A phosphorus acid ester may be prepared by reacting a phosphorus compound such as phosphorus pentoxide with an alcohol. Suitable alcohols include those containing up to 30 or to 24, or to 12 carbon atoms, including primary or secondary alcohols such as isopropyl, butyl, amyl, s-amyl, 2-ethylhexyl, hexyl, cyclohexyl, octyl, decyl and oleyl alcohols, as well as any of a variety of commercial alcohol mixtures having, e.g., 8 to 10, 12 to 18, or 18 to 28 carbon atoms. Polyols such as diols may also be used. The amines which may be suitable for use as the amine salt include primary amines, secondary amines, tertiary amines, and mixtures thereof, including amines with at least one hydrocarbyl group, or, in certain embodiments, two or three hydrocarbyl groups having, e.g., 2 to 30 or 8 to 26 or 10 to 20 or 13 to 19 carbon atoms. The amount may be suitable to provide phosphorus to the lubricant composition in an amount of 200 to 3000 parts per million by weight (ppm), or 400 to 2000 ppm, or 600 to 1500 ppm, or 700 to 1100 ppm, or 1100 to 1800 ppm.

In one embodiment, the phosphorous amine salts can include, for example, a substantially sulfur-free alkyl phosphate amine salt having at least 30 mole percent of the phosphorus atoms in an alkyl pyrophosphate structure (sometimes referred to as the POP structure), as opposed to an orthophosphate (or monomeric phosphate) structure, as shown, for example, in the following formula $R^1O(O_2)POP(O_2)OR^1\cdot(R^2_3)NH^+$, or variants thereof, where, each $R^1$ is independently an alkyl group of 3 to 12 carbon atoms, and each $R^2$ is independently hydrogen or a hydrocarbyl group or an ester-containing group, or an ether-containing group, provided that at least one $R^2$ group is a hydrocarbyl group or an ester-containing group or an ether-containing group (that is, not $NH_3$). The amount of the substantially sulfur-free alkyl phosphate amine salt in the automotive gear oil may be 0.1 to 5 percent by weight. Alternative amounts of the alkyl phosphate amine salt may be 0.2 to 3 percent, or 0.2 to 1.2 percent, or 0.5 to 2 percent, or 0.6 to 1.7 percent, or 0.6 to 1.5 percent, or 0.7 to 1.2 percent by weight. The amount may be suitable to provide phosphorus to the lubricant composition in an amount of 200 to 3000 parts per million by weight (ppm), or 400 to 2000 ppm, or 600 to 1500 ppm, or 700 to 1100 ppm, or 1100 to 1800 ppm.

Further phosphorous amine salts can be the amine salt of a phosphate hydrocarbon ester prepared by reaction between phosphorus pentoxide with an alcohol (having 4 to 18 carbon atoms), followed by a reaction with a primary (e.g., 2-ethylhexylamine), secondary (e.g., dimethylamine), or tertiary (e.g., dimethyloleylamine) amine to form an amine salt of a phosphate hydrocarbon ester. The amount may be suitable to provide phosphorus to the lubricant composition in an amount of 200 to 3000 parts per million by weight (ppm), or 400 to 2000 ppm, or 600 to 1500 ppm, or 700 to 1100 ppm, or 1100 to 1800 ppm.

In one embodiment, sulfur containing amine phosphate salts may be prepared by reacting an alkylthiophosphate with an epoxide or a polyhydric alcohol, such as glycerol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Ethylene oxide and propylene oxide are preferred. The glycols may be aliphatic glycols having from 2 to about 12, or from 2 to about 6, or from 2 or 3 carbon atoms. Glycols include ethylene glycol, propylene glycol, and the like. The alkylthiophosphate, glycols, epoxides, inorganic phosphorus reagents and methods of reacting the same are described in U.S. Pat. Nos. 3,197,405 and 3,544,465 which are incorporated herein by reference for their disclosure to these.

In some embodiments the non-metal phosphorus-containing compound can be a phosphite or a phosphonate. Suitable phosphites or phosphonates include those having at least one hydrocarbyl group with 3 or 4 or more, or 8 or more, or 12 or more, carbon atoms. The phosphite may be a mono-hydrocarbyl substituted phosphite, a dihydrocarbyl substituted phosphite, or a tri-hydrocarbyl substituted phosphite. The phosphonate may be a mono-hydrocarbyl substituted phosphonate, a di-hydrocarbyl substituted phosphonate, or a tri-hydrocarbyl substituted phosphonate.

In one embodiment the phosphite is sulphur-free i.e., the phosphite is not a thiophosphite.

The phosphite or phosphonate may be represented by the formulae:

XI

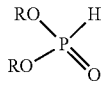

XII

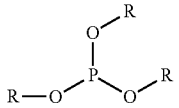

wherein at least one R may be a hydrocarbyl group containing at least 3 carbon atoms and the other R groups may be hydrogen. In one embodiment, two of the R groups are hydrocarbyl groups, and the third is hydrogen. In one embodiment every R group is a hydrocarbyl group, i.e., the phosphite is a tri-hydrocarbyl substituted phosphite. The hydrocarbyl groups may be alkyl, cycloalkyl, aryl, acyclic or mixtures thereof. The R hydrocarbyl groups may be linear or branched, typically linear, and saturated or unsaturated, typically saturated.

In one embodiment, the phosphorus-containing compound can be a $C_{3-8}$ hydrocarbyl phosphite, or mixtures thereof, i.e., wherein each R may independently be hydrogen or a hydrocarbyl group having 3 to 8, or 4 to 6 carbon atoms, typically 4 carbon atoms. Typically the $C_{3-8}$ hydrocarbyl phosphite comprises dibutyl phosphite. The $C_{3-8}$ hydrocarbyl phosphite may deliver at least 175 ppm, or at least 200 ppm of the total amount of phosphorus delivered by the phosphorus-containing compounds. When included, the $C_{3-8}$ hydrocarbyl phosphite may deliver at least 45 wt %, or 50 wt % to 100 wt %, or 50 wt % to 90 wt % or 60 wt % to 80 wt % of the total amount of phosphorus from the non-metal phosphorus-containing compound.

In one embodiment, the phosphorus-containing compound can be a $C_{12-22}$ hydrocarbyl phosphite, or mixtures thereof, i.e., wherein each R may independently be hydrogen or a hydrocarbyl group having 12 to 24, or 14 to 20 carbon atoms, typically 16 to 18 carbon atoms. Typically the $C_{12-22}$ hydrocarbyl phosphite comprises a $C_{16-18}$ hydrocarbyl phosphite. Examples of alkyl groups for $R^3$, $R^4$ and $R^5$ include octyl, 2-ethylhexyl, nonyl, decyl, undecyl, dodecyl, tridecyl, tetradecyl, pentadecyl, hexadecyl, heptadecyl, octadecyl, octadecenyl, nonadecyl, eicosyl or mixtures thereof. The $C_{12-22}$ hydrocarbyl phosphite may be present in the lubricant composition at about 0.05 wt. % to about 1.5 wt. % of the lubricant composition, or from about 0.1 wt. % to about 1.0 wt. % of the lubricant composition.

In some embodiments, the phosphorous containing compound can include both a $C_{3-8}$ and a $C_{12}$ to $C_{24}$ hydrocarbyl phosphite.

In one embodiment, the phosphite ester comprises the reaction product of (a) a monomeric phosphorus acid or an ester thereof with (b) at least two alkylene diols; a first alkylene diol (i) having two hydroxy groups in a 1,4 or 1,5 or 1,6 relationship; and a second alkylene diol (ii) being an alkyl-substitute 1,3-propylene glycol.

Sulfur containing phosphites can include, for example, a material represented by the formula $[R^1O(OR^2)(S)PSC_2H_4(C)(O)OR^4O]_nP(OR^5)_{2-n}(O)H$, wherein $R^1$ and $R^2$ are each independently hydrocarbyl groups of 3 to 12 carbon atoms, or 6 to 8 carbon atoms, or wherein $R^1$ and $R^2$ together with the adjacent O and P atoms form a ring containing 2 to 6 carbon atoms; $R^4$ is an alkylene group of 2 to 6 carbon atoms or 2 to 4 carbon atoms; $R^5$ is hydrogen or a hydrocarbyl group of 1 to about 12 carbon atoms; and n is 1 or 2. The $C_{12-22}$ hydrocarbyl phosphite may be present in the lubricant composition at about 0.05 wt. % to about 1.5 wt. % of the lubricant composition, or from about 0.1 wt. % to about 1.0 wt. % of the lubricant composition.

Phosphorous Content of the Lubricant Composition

The lubricant composition can have a total phosphorous level of about 300 ppm to about 4000 ppm, or even about 400 ppm to about 3000 ppm, or 500 ppm to about 2500 ppm. In an embodiment, the total phosphorous level of the lubricant composition can be greater than 1000 ppm, or greater than 1500 ppm, or greater than 2000 ppm, or 2500 ppm or even greater than 4000 ppm.

In an embodiment, the metal thiophosphate can provide from about 15 to about 80% of the total phosphorus in the lubricant composition. In an embodiment, the metal thiophosphate can provide from about 15 to about 30% of the total phosphorus in the lubricant composition. In an embodiment, the metal thiophosphate can provide from about 50 to about 80% of the total phosphorus in the lubricant composition.

In some embodiments, the ratio of the total content of phosphorous in the lubricant composition to the phosphorous content provided specifically from the metal thiophosphate can be in the range of about 15 to about 75, or from about 19 to about 70. In some embodiments, the ratio of the total content of phosphorous in the lubricant composition to the phosphorous content provided specifically from the metal thiophosphate can be in the range of about 15 to about 30, or from about 19 to about 26 wt. %. In some embodiments, the ratio of the total content of phosphorous in the lubricant composition to the phosphorous content provided specifically from the metal thiophosphate can be in the range of about 60 to about 75 wt. %, or from about 65 to about 70 wt. %.

Sulfur-Containing Additives

The lubricant composition can also contain other sulfur containing compounds, such as, for example, organo-sulfides, including polysulfides, such as sulfurized olefins, thiadiazoles and thiadiazole adducts such as post treated dispersants. The organo-sulfide can be present in a range of 0 wt % to 10 wt %, 0.01 wt % to 10 wt %, 0.1 wt % to 8 wt %, 0.25 wt % to 6 wt %, 2 wt % to 5 wt %, or 3 wt % to 5 wt % of the lubricating composition.

Examples of a thiadiazole include 2,5-dimercapto-1,3,4-thiadiazole, or oligomers thereof, a hydrocarbyl-substituted 2,5-dimercapto-1,3-4-thiadiazole, a hydrocarbylthio-substituted 2,5-dimercapto-1,3-4-thiadiazole, or oligomers thereof. The oligomers of hydrocarbyl-substituted 2,5-dimercapto-1,3-4-thiadiazole typically form by forming a sulfur-sulfur bond between 2,5-dimercapto-1,3-4-thiadiazole units to form oligomers of two or more of said thiadiazole units. Further examples of thiadiazole compounds are found in WO 2008,094759, paragraphs 0088 through 0090.

In an embodiment, the lubricant composition can include a thiadiazole, or derivative thereof, in a range of between 0.07 and 0.5 wt. % of the composition, or from about 0.15 to about 0.3 wt. %.

The organosulfide may alternatively be a polysulfide. In one embodiment at least about 50 wt % of the polysulfide molecules are a mixture of tri- or tetra-sulfides. In other embodiments at least about 55 wt %, or at least about 60 wt % of the polysulfide molecules are a mixture of tri- or tetra-sulfides. The polysulfides include sulfurized organic polysulfides from oils, fatty acids or ester, olefins or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulfurized fatty acid esters prepared from mixed unsaturated fatty acid esters such as are obtained from animal fats and vegetable oils, including tall oil, linseed oil, soybean oil, rapeseed oil, and fish oil.

The polysulfide may also be derived from an olefin derived from a wide range of alkenes, typically having one or more double bonds. The olefins in one embodiment contain 3 to 30 carbon atoms. In other embodiments, olefins contain 3 to 16, or 3 to 9 carbon atoms. In one embodiment the sulfurized olefin includes an olefin derived from propylene, isobutylene, pentene, or mixtures thereof. In one embodiment the polysulfide comprises a polyolefin derived from polymerizing, by known techniques, an olefin as described above. In one embodiment the polysulfide includes dibutyl tetrasulfide, sulfurized methyl ester of oleic acid, sulfurized alkylphenol, sulfurized dipentene, sulfurized dicyclopentadiene, sulfurized terpene, and sulfurized Diels-Alder adducts; phosphosulfurized hydrocarbons.

In an embodiment, the lubricant composition can include a polysulfide between 0 and 2.2 wt. %. In an embodiment, the lubricant composition can have a total sulfur level from all additives (i.e., not including base oil) of about 0.5 or 0.6 to about 3 wt. %, or from about 0.5 or 0.6 to about 2 wt. %. In another embodiment, the lubricant composition can have a total sulfur level from all additives (i.e., not including base oil) of about 0.2 to about 0.75 wt %, or from about 0.25 to about 0.5 wt. %.

In an embodiment, the lubricant composition can be substantially free, or free of sulfurized olefin.

Other Additives

Other materials may be present in the lubricant composition in their conventional amounts including, for example, detergents, viscosity modifiers, dispersants, antioxidants, and friction modifiers, for example. Other additives that may optionally be used in the lubricant composition, in their conventional amounts, include pour point depressing agents, extreme pressure agents, dimercaptothiadiazole compounds, color stabilizers and anti-foam agents, for example.

In an embodiment, the lubricant composition can include a borated dispersant in an amount of about 0.4 to about 2.1 wt. %. Borated dispersants are described in more detail in U.S. Pat. Nos. 3,087,936 and 3,254,025. Borated dispersants are typically derived from an N-substituted long chain alkenyl succinimide. In one embodiment the borated dispersant can include a polyisobutylene succinimide. The number average molecular weight of the hydrocarbon from which the long chain alkenyl group was derived includes ranges of 350 to 5000, or 500 to 3000, or 550 to 1500. The long chain alkenyl group may have a number average molecular weight of 550, or 750, or 950 to 1000. The N-substituted long chain alkenyl succinimides are borated using a variety of agents including boric acid (for example, metaboric acid, HBO, orthoboric acid, $H_3BO_3$, and tetraboric acid, $H_2B_4O_7$), boric oxide, boron trioxide, and alkyl borates. In one embodiment the borating agent can be boric acid which may be used alone or in combination with other borating agents.

The borated dispersant may be prepared by blending the boron compound and the N-substituted long chain alkenyl succinimides and heating them at a suitable temperature, such as, 80° C. to 250° C., or 90° C. to 230° C., or 100° C. to 210° C., until the desired reaction has occurred. The molar ratio of the boron compounds to the N-substituted long chain alkenyl succinimides may have ranges including 10:1 to 1:4, or 4:1 to 1:3; or the molar ratio of the boron compounds to the N-substituted long chain alkenyl succinimides may be 1:2. An inert liquid may be used in performing the reaction. The liquid may include toluene, xylene, chlorobenzene, dimethylformamide or mixtures thereof.

In an embodiment, the lubricant composition can include a detergent. Exemplary detergents include neutral or overbased, Newtonian or non-Newtonian, basic salts of alkali, alkaline earth and transition metals with one or more of a phenate, a sulfurized phenate, a sulfonate, a carboxylic acid, a phosphorus acid, a mono- and/or a di-thiophosphoric acid, a saligenin, an alkylsalicylate, a salixarate or mixtures thereof. A neutral detergent has a metal:detergent (soap) molar ratio of approximately one. An overbased detergent has a metal:detergent molar ratio exceeding one, i.e., the metal content is more than that necessary to provide for a neutral salt of the detergent. In one embodiment, the lubricant composition comprises at least one overbased metal-containing detergent with a metal:detergent molar ratio of at least 3, and in one embodiment a molar ratio up to 1.5. The overbased detergent may have a metal:detergent molar ratio of at least 5, or at least 8, or at least 12. In one embodiment, the overbased detergent is a salicylate detergent. In one embodiment, the alkali or alkaline earth metal overbased detergent comprises a calcium, sodium, or magnesium detergent, or combination thereof. In one embodiment, the metal detergent comprises a calcium detergent. The overbased detergent may be present at 0.1 wt % to 5 wt %, or 0.2 wt % to 3 wt %, or 0.4 wt % to 1.5 wt %.

In an embodiment, the lubricant composition can be substantially free, or free of detergent.

In one embodiment the final lubricant composition can have a kinematic viscosity at 100° C. by ASTM D445 of 3 to 30, 3 to 25, 3 to 18.5, or 3.25 to 17.5, or 3.5 to 16.5, or 3.75 to 15.5 $mm^2/s$. In some embodiments, the final lubricant composition can have a kinematic viscosity at 100° C. by ASTM D445 of 3 to 7, or 4 to 6.5, or 4.5 to 6 $mm^2/s$.

The disclosed technology provides a method of lubricating automotive gears, axles, and bearings, comprising supplying thereto a lubricant composition as described herein, that is, a lubricant composition containing (a) an oil of lubricating viscosity, (b) a metal thiophosphate, (c) a non-metal phosphorous containing compound, and operating the automotive gears, axles, and bearings.

The automotive gear may comprise a gear as in a gearbox of a vehicle (e.g., a manual transmission) or in an axle or differential, or in other driveline power transmitting devices. Lubricated gears may include hypoid gears, such as those for example in a rear drive axle.

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction. The resulting product is still considered a condensation product.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

- hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);
- substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);
- hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described herein may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The invention herein may be better understood with reference to the following examples.

EXAMPLES

Sample lubricant composition for automotive gears, axles and bearings were prepared for testing under ASTM D7452 (formerly L-42) according to the sample formulation provided below.

| | |
|---|---|
| Metal-free dithiophosphate | 1.3 |
| Acrylate copolymer | 0.25 |
| Friction modifier | 0.1 |
| Metal-free friction modifier | 0.1 |
| Dispersant | 0.77 |
| Rust inhibitor | 0.15 |
| Metal-free phosphate | 1.5 |
| Substituted thiadiazole | Variable, |
| Secondary ZDDP | See Table 1 |
| Primary ZDDP | |
| Sulfurized olefin | |
| Oil of lubricating viscosity | Sum to 100 |

ASTM D7452 (former L-42) measures load carrying properties of lubricants under conditions of high speed and shock loading. The test evaluates scuffing and scoring of a surface of the coast side of a gear relative to a reference fluid (specified by ASTM D7452) and a lower rating at the end of test (EOT) indicates a better result. Lower ratings on scuffing indicate a lubricant is able to minimize gear distress under shock loading. The values in tables 1 to 5 below represent the percentage of scoring or scuffing on the gear surface.

Table 1 shows the response of sulfurized olefin and dimercaptothiadiazole adducts to shock load testing. Based on the information below, it is clear that a level greater than 2.8 wt % of sulfurized olefin is required (compare results for Samples 1, 2 and 3; lower numbers indicate better performance). Increased levels of substituted thiadiazole does not significantly enhance performance (Compare Sample 4 to Sample 3). The introduction of a modest amount of primary or secondary zinc dialkyldithiophosphate ("ZDDP") in Samples 5 and 6 demonstrates a significant improvement in performance compared to Sample 3.

TABLE 1

ASTM D7452 results at various levels of sulfurized olefin and in the presence and absence of ZDDP.

| | Sample 1 | Sample 2 | Sample 3 | Sample 4 | Sample 5 | Sample 6 |
|---|---|---|---|---|---|---|
| Substituted thiadiazole | 0.15 | 0.15 | 0.15 | 0.46 | 0.15 | 0.15 |
| Primary ZDDP | | | | | 0.45 | |

TABLE 1-continued

ASTM D7452 results at various levels of sulfurized olefin and in the presence and absence of ZDDP.

| | Sample 1 | Sample 2 | Sample 3 | Sample 4 | Sample 5 | Sample 6 |
|---|---|---|---|---|---|---|
| Secondary ZDDP | | | | | | 0.45 |
| Sulfurized olefin | 3.3 | 2.8 | 2.2 | 2.2 | 2.2 | 2.2 |
| % P | 0.1881 | 0.1875 | 0.1896 | 0.1859 | 0.2174 | 0.2373 |
| % S | 1.76 | 1.48 | 1.235 | 1.337 | 1.292 | 1.339 |
| % Zn | | | | | 0.0446 | 0.0594 |
| L-42 Result | | | | | | |
| EOT Ring Coast % | 4 | 15 | 65 | 75 | 24 | 7 |
| EOT Pin Coast % | 8 | 22 | 90 | 85 | 31 | 13 |

Samples 7-9 in Table 2 contain increased levels of thiadiazole in an effort to partially offset the reduced level of sulfurized olefin present. Note the reduced sulfur content (~1.5% for Samples 7 and 8, and ~0.75% for Sample 9) compared to the typical sulfur content of greater than 2%. A passing result requires lower % coast side scuffing/scoring for the test candidate than the reference oil with no evidence of drive side scuffing or scoring on the test candidate. Sample 7 contained 1.82 wt % ZDDP. Sample 8 was formulated to the equivalent phosphorus level as sample 7, but using additional metal-free dithiophosphate (instead of ZDDP). Both passing results are unexpected as typical formulating of gear oils requires approximately >3 wt % sulfurized olefin (as shown in Table 1) to pass, even at high concentrations of substituted thiadiazole. The results indicate dithiophosphate extreme pressure (EP) character is strong at higher than normal P levels irrespective of the presence of Zn, however the improvement in EOT ring coast % and EOT pin coast % ratings highlight that the type of dithiophosphate and/or the Zn present in ZDDP makes a more effective EP additive at equal P levels.

TABLE 2

ASTM D7452 results of low sulfur fluids.

| | Sample 7 | Sample 8 | Sample 9 |
|---|---|---|---|
| Olefin copolymer | 14.6 | 14.6 | 14.6 |
| Dispersant | 1.32 | 1.32 | 1.83 |
| Sulfurized olefin | 2 | 2 | 0 |
| Substituted thiadiazole | 0.5 | 0.5 | 0.5 |
| metal-free dithiophosphates | 1.2 | 3.6 | 1.2 |
| Secondary ZDDP | 1.82 | | 1.82 |
| Oil of Lubricating Viscosity | | Sum to 100 | |
| % P | 0.302 | 0.307 | 0.3 |
| % S | 1.588 | 1.428 | 0.76 |
| % Zn | 0.23 | 0 | 0.23 |
| L-42 Result | | | |
| EOT Ring Coast % | 2 | 8 | 10 |
| EOT Pin Coast % | 4 | 15 | 17 |

Sample 9 represents a fluid similar to Sample 7, however, in Sample 9, the sulfurized olefin was completely removed from the formulation. The passing results obtained for Samples 7-9 are unexpected given the low total sulfur levels present in these fluids.

Table 3 shows the impact of reducing the substituted thiadiazole to levels at low sulfurized olefin levels to further demonstrate the effectiveness of ZDDP at even lower EP levels when compared to other metal-free dithiophosphates. The results reported for Samples 11 and 12 confirm that not all thiophosphates are capable of improving the load carrying of the fluid even in the presence of sulfurized olefin.

TABLE 3

ASTM D7452 with reduced thiadiazole and varying dithiophosphates.

| | Sample 10 | Sample 11 | Sample 12 |
|---|---|---|---|
| Dispersant | 1.1 | 1.1 | 1.1 |
| Substituted thiadiazole | 0.2 | 0.2 | 0.2 |
| metal-free dithiophosphate-1 | 1.2 | 3.6 | 1.2 |
| metal free dithiophosphate-2 | | | 2.5 |
| Secondary ZDDP | 1.82 | | |
| Sulfurized olefin | 2 | 2 | 2 |
| Olefin copolymer | 14.6 | 14.6 | 14.6 |
| Oil of Lubricating Viscosity | | Sum to 100 | |
| % P | 0.31 | 0.3 | 0.39 |
| % S | 1.53 | 1.31 | 1.77 |
| % Zn | 0.22 | | |
| L-42 Result | | | |
| EOT Ring Coast % | 2 | 13 | 38 |
| EOT Pin Coast % | 5 | 21 | 55 |

In addition to AGO formulations, improved scuffing performance can also be observed in applications requiring spur gear scuffing/adhesive wear improvements such as manual transmission applications. ISO 14635-2 (also known as FZG A10/16.6R/120) is run with the test lubricant at constant speed for a fixed number of revolutions using dip lubrication mode. Loading of the gear teeth is increased in defined steps. After load stage 4, the pinion tooth flanks are inspected for surface damage at the end of each load stage and any changes in appearance are noted. A test is considered complete when either the failure criteria has been met or when load stage 10 is run without meeting the failure criteria. The higher the failure load stage the better. Samples 13-16 were evaluated using this test method. The comparison in Table 4 shows the improvement in scuffing through the substitution of amine phosphate anti wear with ZDDP to equal phosphorus. The scuffing performance on manual transmission fluids is a critical performance parameter and is based on the prevention of adhesive wear. The substitution of amine phosphate for ZDDP at equal phosphorus enhances the scuffing to a load stage 10 failure in the presence of high or low substituted thiadiazole treat.

TABLE 4

FZG A10/16.6R/120 Scuffing Test of manual transmission fluids

| | Sample 13 | Sample 14 | Sample 15 | Sample 16 |
|---|---|---|---|---|
| Dispersant | 0.57 | 0.57 | 0.57 | 0.57 |
| Substituted thiadiazole | 0.1 | 0.1 | 0.25 | 0.25 |
| Secondary ZDDP | | 0.21 | | 0.21 |
| Metal-free amine phosphate | 1.07 | 0.8 | 1.07 | 0.8 |

TABLE 4-continued

| FZG A10/16.6R/120 Scuffing Test of manual transmission fluids | | | | |
|---|---|---|---|---|
| | Sample 13 | Sample 14 | Sample 15 | Sample 16 |
| Antioxidant | 0.3 | 0.3 | 0.3 | 0.3 |
| Detergent | 0.58 | 0.58 | 0.58 | 0.58 |
| Sulfurized olefin | 0.5 | 0.5 | 0.5 | 0.5 |
| Ester copolymer | 7 | 7 | 7 | 7 |
| Oil of Lubricating Viscosity | | Sum to 100 | | |
| % P | 0.092 | 0.088 | 0.092 | 0.094 |
| % S | 0.25 | 0.32 | 0.32 | 0.37 |
| % Zn | | 0.0267 | | 0.0263 |
| failure load stage | 7 | 10 | 9 | 10 |

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as optionally modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of" where "consisting of" excludes any element or step not specified and "consisting essentially of" permits the inclusion of additional un-recited elements or steps that do not materially affect the essential or basic and novel characteristics of the composition or method under consideration. The expression "consisting of" or "consisting essentially of," when applied to an element of a claim, is intended to restrict all species of the type represented by that element, notwithstanding the presence of "comprising" elsewhere in the claim.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

A lubricant composition for an automotive gear comprising, an oil of lubricating viscosity; a metal thiophosphate, and a non-metal phosphorous containing compound. The lubricant composition of the preceding sentence, wherein the metal thiophosphate comprises zinc dialkyldithiophosphate. The lubricant composition of any preceding sentence, wherein the zinc dialkyldithiophosphate comprises, consists essentially of, or consists of a primary zinc dialkyldithiophosphate. The lubricant composition of any preceding sentence, wherein the zinc dialkyldithiophosphate comprises, consists essentially of, or consists of a secondary zinc dialkyldithiophosphate. The lubricant composition of any of any preceding sentence, wherein the zinc dialkyldithiophosphate provides 100 ppm zinc or greater to the lubricant composition. The lubricant composition of any preceding sentence, wherein the zinc dialkyldithiophosphate provides from 100 to 5000 ppm zinc to the lubricant composition. The lubricant composition of any preceding sentence, wherein the zinc dialkyldithiophosphate provides from 150 to 4000 ppm zinc to the lubricant composition. The lubricant composition of any of any preceding sentence, wherein the zinc dialkyldithiophosphate provides from 200 to 3000 ppm zinc to the lubricant composition. The lubricant composition of any preceding sentence, wherein the non-metal phosphorous containing compound comprises, consists essentially of, or consists of at least one of a phosphorous amine salt, a sulfur containing phosphorous amine salt, a phosphite, a sulfur containing phosphite, a non-metal dithiophosphates, or mixtures thereof. The lubricant composition of any preceding sentence, wherein the non-metal phosphorous containing compound comprises, consists essentially of, or consists of a phosphorous amine salt. The lubricant composition of any preceding sentence, wherein the non-metal phosphorous containing compound comprises, consists essentially of, or consists of a sulfur containing phosphorous amine salt. The lubricant composition of any preceding sentence, wherein the non-metal phosphorous containing compound comprises, consists essentially of, or consists of a phosphite. The lubricant composition of any preceding sentence, wherein the non-metal phosphorous containing compound comprises, consists essentially of, or consists of a sulfur containing phosphite. The lubricant composition of any preceding sentence, wherein the non-metal phosphorous containing compound comprises, consists essentially of, or consists of a non-metal dithiophosphates. The lubricant composition of any preceding sentence, wherein the non-metal phosphorous containing compound provides phosphorus to the lubricant composition in an amount of 200 to 3000 parts per million by weight (ppm). The lubricant composition of any preceding sentence, wherein the non-metal phosphorous containing compound provides phosphorus to the lubricant composition in an amount of 400 to 2000 ppm. The lubricant composition of any preceding sentence, wherein the non-metal phosphorous containing compound provides phosphorus to the lubricant composition in an amount of 600 to 1500 ppm. The lubricant composition of any preceding sentence, wherein the non-metal phosphorous containing compound provides phosphorus to the lubricant composition in an amount of 700 to 1100 ppm. The lubricant composition of any preceding sentence, wherein the non-metal phosphorous containing compound provides phosphorus to the lubricant composition in an amount of 1100 to 1800 ppm. The lubricant composition of any preceding sentence having a total phosphorous level of about 300 ppm to about 4000 ppm. The lubricant composition of any preceding sentence having a total phosphorous level of about 400 ppm to about 3000 ppm. The lubricant composition of any preceding sentence having a total phosphorous level of about 500 ppm to about 2500 ppm. The lubricant composition of any preceding sentence having a total phosphorous level of greater than 1000 ppm. The lubricant composition of any preceding sentence having a total phosphorous level of greater than 1500 ppm. The lubricant composition of any preceding sentence having a total phosphorous level of greater than 2000 ppm. The lubricant composition of any preceding sentence having a total phosphorous level of greater than 2500 ppm. The lubricant composition of any preceding sentence having a total phosphorous level of greater than 4000 ppm. The lubricant composition of any preceding sentence, wherein the metal thiophosphate provides from about 15 to about 80% of the total phosphorus in the lubricant composition. The lubricant composition of any preceding sentence, wherein the metal thiophosphate provides from about 15 to about 30% of the total phosphorus in the lubricant composition. The lubricant composition of any preceding sentence, wherein the metal thiophosphate provides from about 50 to about 80% of the total phosphorus in the lubricant composition. The lubricant of any preceding sentence, further comprising a sulfurized olefin between 0 and 2.2 wt. %. The lubricant of any preceding sentence, where the lubricant composition is substantially free, or free of sulfurized olefin. The lubricant composition of any preceding sentence, wherein the lubricant comprises a total sulfur level from all additives (i.e., not including base oil) of about 0.5 to about 3 wt %. The lubricant composition of any preceding sentence, wherein the lubricant comprises a total sulfur level from all additives (i.e., not including base oil) of about 0.2 to about 0.75 wt. %. The lubricant composition of any preceding sentence, wherein the ratio of the total content of phosphorous in the lubricant composition to the phosphorous content provided specifically from the metal thiophosphate is in the range of about 15 to about 30. The lubricant composition of any preceding sentence, wherein the ratio of the total content of phosphorous in the lubricant composition to the phosphorous content provided specifically from the metal thiophosphate is in the range of about 19 to about 26 wt. %. The lubricant composition of any preceding sentence, wherein the ratio of the total content of phosphorous in the lubricant composition to the phosphorous content provided specifically from the metal thiophosphate is in the range of about 60 to about 75 wt. %. The lubricant composition of any preceding sentence, wherein the ratio of the total content of phosphorous in the lubricant composition to the phosphorous content provided specifically from the metal thiophosphate is in the range of about 65 to about 70 wt. %. The lubricant composition of any preceding sentence, wherein the lubricant is substantially detergent free. The lubricant composition of any preceding sentence, further comprising a detergent. The lubricant composition of any preceding sentence, further comprising between 0.07 and 0.5 wt. % of a thiadiazole or derivative thereof. The lubricant composition of any preceding sentence, further comprising a borated dispersant.

A method of lubricating an automotive gear, axle and/or bearing, comprising supplying to the automotive gear, axle and/or bearing the lubricant composition of the preceding paragraph, and operating the automotive gear, axle and/or bearing. The method of the first sentence of this paragraph wherein the driveline device comprises an axle. The method of the first sentence of this paragraph, wherein the driveline device comprises a bearing. The method of the first sentence of this paragraph, wherein the driveline device comprises a gear.

What is claimed is:

1. A lubricant composition for an automotive gear comprising a. an oil of lubricating viscosity;

b. a zinc thiophosphate to provide from 150 ppm to 3000 ppm zinc, and c. a non-metal phosphorus containing compound, wherein the non-metal phosphorus containing compound comprises at least one of a phosphorus amine salt, a sulfur containing phosphorus amine salt, a phosphite, a phosphonate, a sulfur containing phosphite, a sulfur containing phosphonate, non-metal dithiophosphates, or mixtures thereof, d. between 0.07 and 0.5 wt. % of a thiadiazole or derivative thereof, and e. a sulfurized olefin between 2 and 3 wt. %, wherein the lubricant comprises a total sulfur level from all additives (i.e., not including base oil) of about 0.5 to about 2 wt % and a total phosphorus level of about 500 ppm to about 1500 ppm.

2. The lubricant composition of claim 1, wherein the zinc thiophosphate comprises zinc dialkyldithiophosphate.

3. The lubricant composition of claim 1, wherein the zinc dialkyldithiophosphate comprises, consists essentially of, or consists of a secondary zinc dialkyldithiophosphate.

4. The lubricant composition of claim 1, wherein the lubricant comprises a total phosphorus level of greater than 1000 ppm.

5. The lubricant composition of claim 1, wherein the lubricant is substantially detergent free.

6. The lubricant composition of claim 1, wherein the metal thiophosphate provides from about 15 to about 80% of the total phosphorus in the composition.

7. The lubricant composition of claim 1, further comprising a detergent.

8. The lubricant composition of claim 1, further comprising a borated dispersant.

9. A method of lubricating an automotive gear, axle and/or bearing, comprising supplying to the automotive gear, axle and/or bearing the lubricant composition of claim 1, and operating the automotive gear, axle, and/or bearing.

10. The method of claim 9 wherein the driveline device comprises an axle.

11. The method of claim 9, wherein the driveline device comprises a bearing.

12. The method of claim 9, wherein the driveline device comprises a gear.

13. The method of claim 9, wherein the driveline device comprises a manual transmission.

14. The lubricant composition of claim 1, wherein the lubricant comprises a total sulfur level from all additives of about 0.5 to about 0.75 wt. %.

* * * * *